US006431373B1

(12) United States Patent
Blick

(10) Patent No.: US 6,431,373 B1
(45) Date of Patent: Aug. 13, 2002

(54) INTEGRATED SUPPORT FOR TOOLS

(76) Inventor: John Blick, 31891 Circle Dr., S. Laguna, CA (US) 92677

( * ) Notice: Subject to any disclaimer, the term of this patent is extended or adjusted under 35 U.S.C. 154(b) by 0 days.

(21) Appl. No.: 09/627,368

(22) Filed: Jul. 28, 2000

Related U.S. Application Data

(63) Continuation-in-part of application No. 09/378,134, filed on Aug. 19, 1999, now abandoned.

(51) Int. Cl.[7] ..... A47F 5/00
(52) U.S. Cl. ..... 211/70.6; 211/162; 206/378
(58) Field of Search ..... 211/162, 94.01, 211/182, 70.6; 206/378

(56) References Cited

U.S. PATENT DOCUMENTS

| | | | | |
|---|---|---|---|---|
| 3,415,477 A | | 12/1968 | Kondur | |
| 3,889,408 A | * | 6/1975 | Offner | 40/661.03 |
| 4,635,801 A | * | 1/1987 | Oren | 211/70.6 |
| 4,805,331 A | | 2/1989 | Boggess | |
| 4,987,988 A | | 1/1991 | Tsai | |
| 5,228,570 A | | 7/1993 | Robinson | |
| 5,284,245 A | | 2/1994 | Slivon et al. | |
| 5,351,926 A | | 10/1994 | Moses | |
| 5,501,342 A | | 3/1996 | Geibel | |
| 5,573,116 A | | 11/1996 | Zink | |
| 5,697,507 A | | 12/1997 | Blass | |
| 5,848,694 A | | 12/1998 | Newton | |
| 5,967,340 A | | 10/1999 | Kao | |
| 5,992,626 A | | 11/1999 | Anderson | |

* cited by examiner

*Primary Examiner*—Daniel P. Stodola
*Assistant Examiner*—Erica B. Harris
(74) *Attorney, Agent, or Firm*—Curtis L. Harrington

(57) ABSTRACT

An integrated support for tools utilizes both round and rectangularly shaped "U" socket tool support members that can be slidably mounted on a metal strip, and displaceable supports that can be mounted on a solidly shaped strip to provide an extended support with which the strip may be supported and stabilized. The extended support may be extruded, cut, or formed in any manner. It provides a body to which the strip may be attached, provides side surfaces that include recessed surfaces to facilitate grasping, and may optionally provide an extended area magnetic base, which works well with metal tool boxes to provide a measure of stability beyond its own weight. The support may actively provide accommodative support to a plurality of strips. The support has a central opening having a pair of oppositely oriented projections at an upper end thereof, that provide an engagement surface for the strip by using a threaded member, or a threaded member in combination with a nut, positioned with the central opening and either applying a facial cutting force against the oppositely oriented projections, or a compressive force against the oppositely oriented projections or restrictions over the central opening, with respect to the engaged nut in order to rotationally fix the threaded member.

18 Claims, 3 Drawing Sheets

INTEGRATED SUPPORT FOR TOOLS

This is a continuation-in-part of U.S. patent application Ser. No. 09/378,134 filed Aug. 19, 1999, now abandoned.

FIELD OF THE INVENTION

The present invention relates to improvements in the field of tool organization, support, handling, and storage. More specifically, the present invention relates to a support base having sides configured to facilitate grasping and visual messages, a magnetic base for stability and which facilitates adjustable engagement of a metal socket rack.

BACKGROUND OF THE INVENTION

The number and types of tool supports are many. All attempt the goal of support, storage, compact organization and ease of use. One support which has long been in use is a metal strap having a series of "U" shaped tool support members engaging the metal strap and slidable, with some resistance, along the metal strap. The curved portion of the "U" shape engages tools, typically a series of sockets, in the same space in which a ratchet wrench engages the socket. The term socket is not limited to nut and bolt head engagement structures but also other driver sets, generally any structure which can be driven by a ratchet. Once the different sized sockets are engaged with the members, the sockets can be compactly lined up along the metal strap.

Other solutions lack some of the advantages of this system employing the metal strap. In one embodiment, a plastic holder has a series of cylindrical holes to support the sockets. Each hole has a spaced apart diameter and height to accommodate a tool of an exact size. However, this design wastes space, wastes plastic, and faces the user with a children's puzzle at the time the tools are to be replaced in their correct holes.

Another system uses a side turning support which axially move to lock and unlock to enable the displacement spacing to change, but supporting relatively heavy and durable metal tools with plastic members which do not truly lock and unlock because they can still be slidably displaced with respect to their carriage base.

The above systems represent the complex and troublesome solutions to the problem of ordering and storing of tools, especially sockets and socket driven tools. One of the most inexpensive and orderly structures for adequately supporting socket driven tools is the metal strap having a series of "U" shaped tool support members as described above. However, due to the light weight nature of the elongate strip and the fact that it projects a relatively narrow support footprint, it is not stable on its own, and tends to fall over, especially when tools are positioned on it. Some users utilize the holes to attach the strip to another object, including a work bench or the inside of a tool box. However, this method causes loss of the ability to re-order the tools within a box, for example, or to carry the set to the work area without carrying the object to which the strip is attached.

What is therefore needed is a device which has the tool holding support, ordering and positionability of the "U" shaped tool support members but the support stability of expanded supports but without taking up additional space. The needed system should provide positive hold, occupy little space, provide stable, upright support and should hold the other tools stable as the user selects one for removal.

SUMMARY OF THE INVENTION

The devices and system of the present invention utilizes the "U" shaped tool support members slidably mounted on the elongate strip which can be made of any length, but provides an extended support with which the elongate strip may be supported and stabilized. The extended support may be extruded, cut, or formed in any manner. If extruded, the support may be expected to have a constant axial profile along its length. The support provides a body for the elongate strip to be attached, provides side surfaces which facilitate grasping, and may optionally provide an extended area magnetic base which works well with metal tool boxes to provide a measure of stability beyond its own weight. The support has a central opening having a pair of oppositely oriented projections which provide engagement with the elongate strip by using a threaded member and a nut positioned within the central slot and sized to be non-rotatable within the slot, and applying a compressive force against the oppositely oriented projections or restrictions over the central opening. Apertures in the elongate strip, which are typically already formed in the elongate strip, are used to accommodate the threaded member. In addition, the elongate strip can be attached to the support by the use of a screw having engaging threads which provide engagement with the elongate strip by applying a facial cutting force against the oppositely oriented facing projections against the oppositely oriented projections. Alternatively, where other material, such as plastic or wood is used, the central slot can be eliminated and the threaded member can penetrate and engage directly into the material of the support, especially where the support is plastic or wood.

The support preferably has a bottom surface attached to an extended surface magnet. An extended surface magnet is utilized due to its expanded area of contact with the bottom of the support and relatively high magnetic holding force attainable with a relatively weak volumetric strength.

The support may also include side recessed areas to facilitate grasping of the support, even over a fully tool loaded elongate strip. The side recessed areas may also include a pair of oppositely disposed vertical grooves for accepting and supporting inserts which can be used for identification. In the alternative, where vertical grooving is not desired, the inserts may be attached by painting, adhesive, glue, or other methods. The support may also include end apertures for engagement with a structure to facilitate hanging from the end as well as and including other structures to facilitate a finished look.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

The description and operation of the invention will be best described with reference to FIG. 1, which illustrates a perspective assembled view. A support system 21 includes a support 23 to which a elongate strip 25 is attached. Support 23 can be of any length and can support a number of elongate strips if desired. Elongate strip 25 includes a series of "U" shaped tool support members 27 which are slidable along the elongate strip 25 with some resistance.

Figure 1:
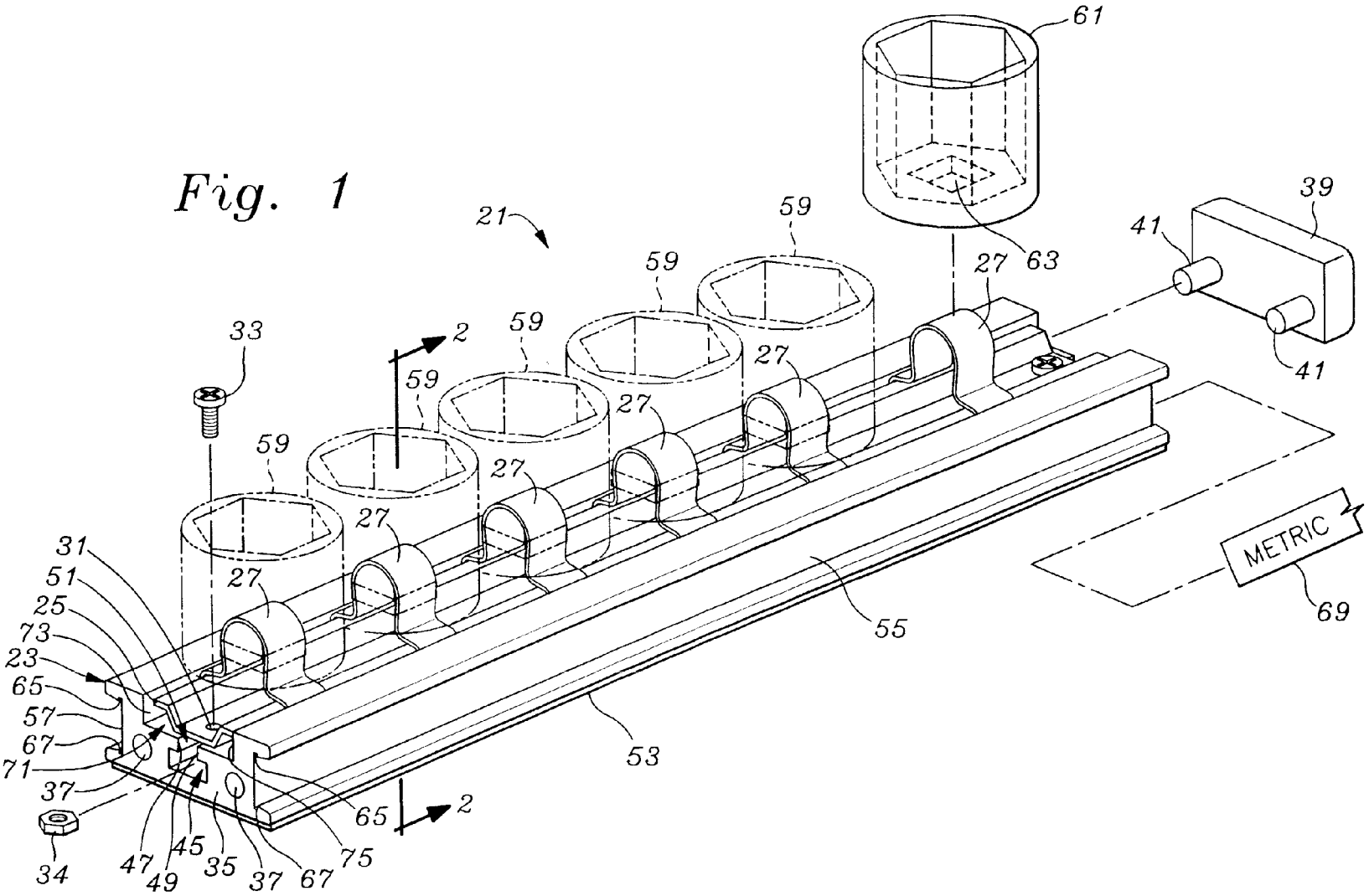
FIG. 1 is a perspective view looking down at a support of the invention and illustrating partially exploded details of attachment of the strip.

The elongate strip 25 usually contains a pair of apertures of which one aperture 31 is seen in FIG. 1, below a threaded member 33 shown in a vertically displaced exploded position over the aperture 31, and including an expanded head larger than aperture 31 in order to engage the elongate strip 25, and having a shaft for extending through the aperture 31. A nut 34, which may preferably be a hexagonal nut 34 or any other shape capable of being captured by a pair of oppositely disposed flat surfaces.

The apertures 31 typically accompany the elongate strip 25 adjacent the ends thereof, but multiple numbers of apertures 31 may be provided along the length of the elongate strip 25. However, two apertures 31 are expected to be more than sufficient to support the elongate strip 25 with respect to the support 23. The elongate strip 25 can be of any length, as can the support 23.

The support 23 is preferably an extrusion, and where it is an extrusion, the features appearing at an end 35 of the extrusion will exist completely through the extrusion. The support 23 may have a pair of through bores 37 extending therethrough, or formed in the ends thereof. The through bores 37 are completely optional and can be utilized for a variety of purposes including reduction of material from a non critical portion of the structure, providing an insertion point for other support structure and providing an insertion point for an end cap or other structure, such as an end cap 39.

The completely optional end cap 39 may have a shape which extends from the portions of the support 23 in a way which makes the end cap 39 a natural end extension of the support 23. The end cap 39 has a pair of projections 41 which can be fixably inserted into the ends of the through bores 37 and secured by either friction or gluing.

The details of operation of the support 23 are seen at the end thereof. A main slot 45 has a relatively wide base and shallow vertical walls. At the top of the main slot 45, a pair of oppositely oriented facing projections 47 and 49 define an entrance slot 51 between them to admit the threaded shaft of the threaded member 33 to engage the nut 34, and enable a sufficient area on the pair of oppositely oriented facing projections 47 and 49, to be engaged by the nut 34 to hold the elongate strip 25 in place. The use of the threaded member 33 and nut 34 within the main slot 45 to act against the projections 47 and 49 on either side of the entrance slot 51 enables the user to center the elongate strip 25 on the support 23, and in the case where a much longer support 23 is available, to secure several individual elongate strips 25 on the support 23.

On the bottom of the support 23 a magnetic strip layer 53 is attached. The extended area of the magnetic strip layer 53 is preferably matched to the bottom surface of the support 23 to give maximum holding strength. The support 23 also includes an outwardly disposed linear depression 55 on along one side and an outwardly disposed linear depression 57 along the other side. These depressions 55 & 57 facilitate grasping of the support 23. A series of sockets 59 are seen in phantom where they overlie the "U" shaped tool support members 27. A socket 61 is seen in solid form and exploded over a "U" shaped support clip 27 and the square lower socket entry space 63 is seen to be in a position to engage the "U" shaped support clip 27.

As a further option, the linear depression 55 may have a smaller pair of oppositely disposed slots 65 and 67 which enable support of a slidably insertable message insert 69 which is seen to have the words "metric" written thereon. In the alternative, message insert 69 may be attached directly to the depressions 55 and 57, whether or not the optional disposed slots 65 and 67 are present. Other writing may be used, including advertising inserts 69, color inserts 69, and possibly even user markable inserts to enable the user to put user information thereon. The smaller pair of oppositely disposed slots 65 and 67 can support the inserts 69 either flat to the depressions 55 and 57 or bowed out for more expression. Further, the depressions 55 and 57 can themselves be bowed in or out for effect and still facilitate manual grasping and manipulation of the support 23 whether the sockets 59 & 61 are in place or not. Also seen is a wide shallow elongate strip accommodation slot 71 having a bottom 72, and side walls 73 and 75. The bottom 72 is interrupted by the entrance slot 51 and its oppositely oriented facing projections 47 and 49. Accommodation slot 71 preferably has sufficient depth to enable the elongate strip 25 to sit low enough within the support 23 to reduce the overall profile, but not so low that the lower end of the tools, such as sockets 59 and 61 would be limited in the extent of their fit over the "U" shaped tool support members 27 to limit their engagement thereon.

Figure 2:
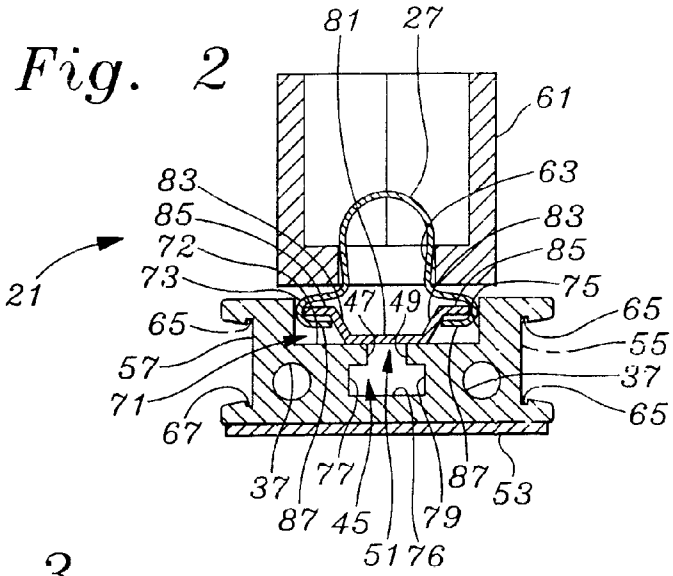
FIG. 2 is an end view taken along line 2—2 of FIG. 1.

Referring to FIG. 2, a side sectional view gives a more complete view of the structures of the support 23 including the base surface 76 and shallow vertical walls 77 & 79. At the top of the main slot 45, a pair of oppositely oriented facing projections 47 and 49 are more clearly seen. It is understood that the same structures seen in FIG. 2 can be engaged with a screw having a body fat enough to engage the oppositely facing sides of the oppositely oriented facing projections 47 and 49. This may tend to deform the facing projections 47 and 49 as well as to limit the ability of the user to locate the elongate strip 25 evenly along the length of the support 23. The elongate strip 25 is seen to be in a generally flat bottomed "V" shape, including a flat bottom 81 with angled side walls 83 forming each leg of the "V" shape from an axial sectional view of FIG. 2, and having a small flat portion 85 extending generally parallel to the flattened bottom. The "U" shaped tool support members 27 generally include smaller "u" shaped portions 87 which engage and wrap around the flattened portions of the "V" shape of the elongate strip 25. The width of the base surface 76, and thus the separation of the shallow vertical walls 77 & 79 insure that the outermost extent of the "U" shaped tool support members 27, generally including the smaller "u" shaped portions discussed, adequately clear and have no interference with the shallow vertical walls 77 & 79 in order that the tool support members 27 remain displaceable along the elongate strip 25 to continue to provide compact ordering to the supported sockets 59 and 61.

Figure 3:
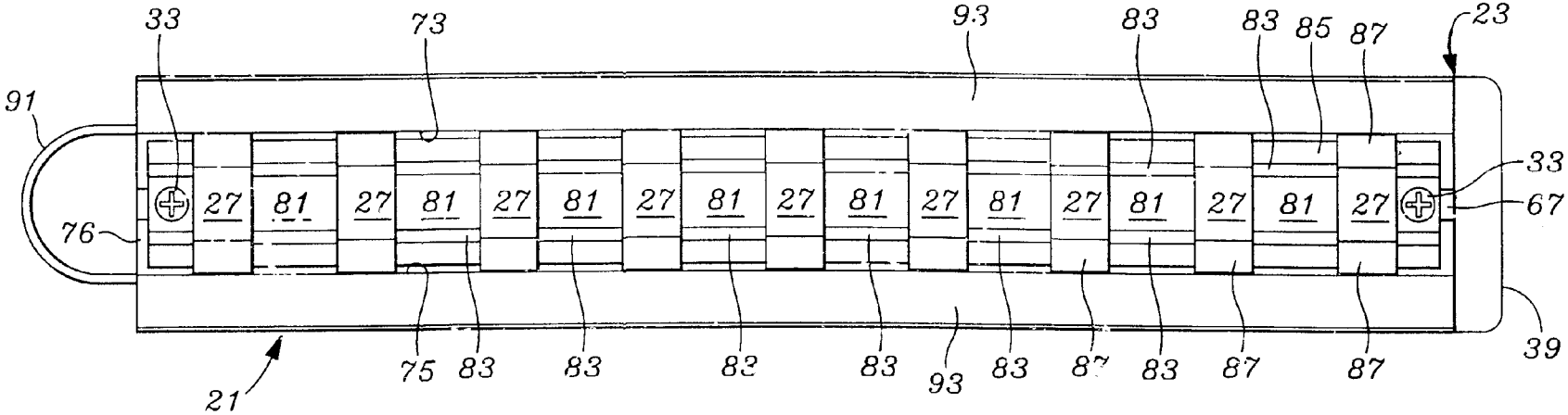
FIG. 3 is a top view of the support of FIGS. 1 & 2.

Referring to FIG. 3, a top view without the sockets 59 and 61 illustrates further details of the system 21, but with a hanger loop 91 having ends inserted into the optional bores 37, if present, to enable the system 21 to be suspended from a hook, nail or other protruding object. Other structure for hanging is possible. A top surface 93 of the support 23 is also most clearly seen, as are the details of the a flat bottom 81, angled side walls 83, and small flat portion 85 of the elongate strip 25. The angled nature of these features gives the elongate strip 25 strength and stability. Also shown is the end cap 39 in place to give the support system 21 a finished look.

Figure 4:
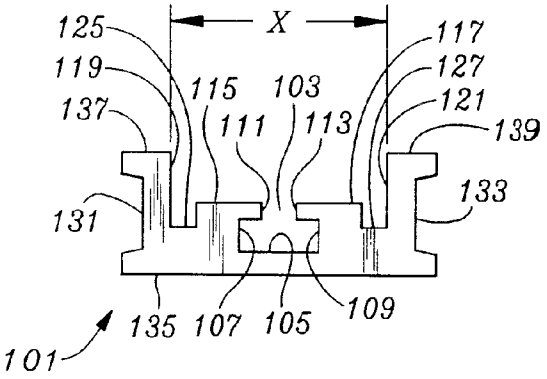
FIG. 4 is an end view of a further embodiment of the support of the invention having a wider profile and a pair of deeper side slots to accommodate material removal.

Referring to FIG. 4, an end view of a further embodiment of the support of the present invention is seen as a support 101. It is shown in simplified view, unobstructed by any strip and slidable supports for a more complete illustration. Support 101 includes a main entrance slot 103 which leads into an opening having a base surface 105 and shallow vertical walls 107 & 109. Defining main entrance slot 103 is a pair of oppositely oriented facing projections 111 and 113. It is understood that the same structures seen in FIG. 4, can, like the structures of FIGS. 1–3 be engaged with a screw having a body fat enough to engage the oppositely facing sides of the oppositely oriented facing projections 111 and 113.

The oppositely oriented facing projections 111 and 113, with their underlying downwardly directed walls, form right angles with upper surfaces 115 and 117. As before, the support 101 has side walls 119 and 121. However, rather than a flat expanse from the upper surfaces 115 and 117 to the side walls 119 and 121, the side walls 119 and 121 continue downward to a depth below the level of the upper surfaces 115 and 117 to form a pair of side slots 125 and 127. Primarily the side slots 125 and 127 are for material removal, but the extrusion of the shape seen in FIG. 4, and including the shape of the side slots 125 and 127 and their relationship and spacing with respect to the oppositely oriented facing projections 111 and 113 is selected to insure that the resulting support 101 can adequately hold any tool stip.

The dimension "X" is indicated as the horizontal separation, taken with respect to the orientation of FIG. 4, between the side walls 119 and 121. This width will vary depending upon the characteristics of the member utilized with the support 101. For example, a magnitude of from about 0.9 inches to about 1.2 inches for the dimension "X" has been found adequate to accommodate a wide range of strips and tool support members such as metal strip 25 and "U" shaped tool support members 27, as well as others to be shown hereafter. This dimension includes the accommodation made to the "U" shaped tool support members 27 and their generally include smaller "u" shaped portions 87 which engage and wrap around the flattened portions of the "V" shape of the elongate strip 25. Also seen is a first outwardly disposed linear depression 131 and a second outwardly disposed linear depression 133, as well as a base surface 135 without a magnetic strip layer 53. The top surfaces 137 and 139 are also seen. The overall depth of the surfaces 115 and 117 will be of such depth as to accommodate a socket 61 above the top surfaces 137 and 139.

Figures 5, 6:
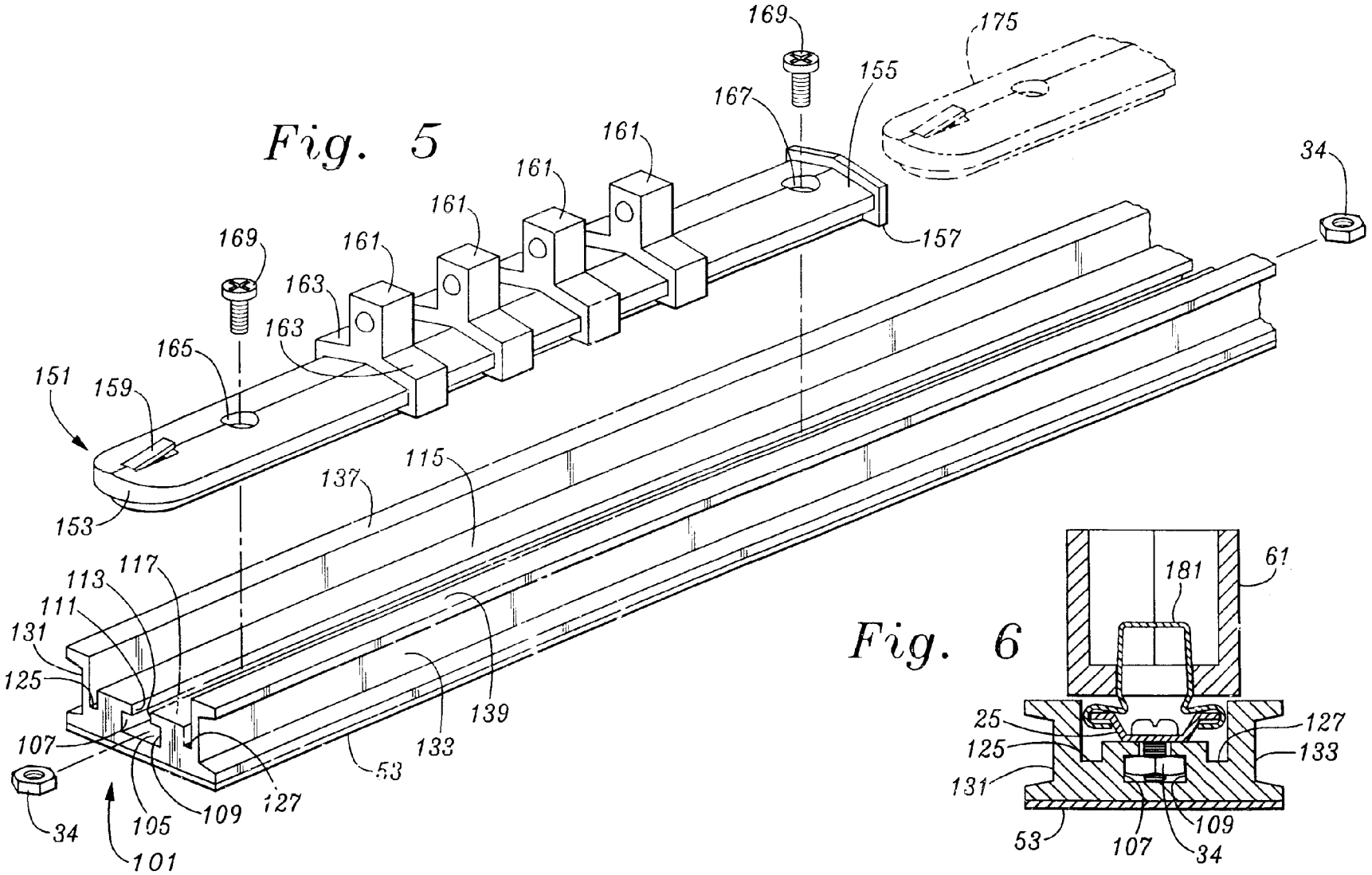
FIG. 5 is an exploded view of a tongue shaped strip supporting a plurality of overfitting members slidably displacable along said strip member and shown above the support of FIG. 4.
FIG. 6 illustrates an end view of the support of FIGS. 4 and 5 shown with a metal strip similar to that seen in FIGS. 1–3 but having rectangular shaped tool support members.

Referring to FIG. 5, an exploded view of an alternative to the metal strip 25 of FIGS. 1–3 is seen as a strip 151 having a first rounded end 153 and a second end 155 bounded by an expanded portion 157. Adjacent the rounded end 153 is a raised spring extension 159 to enable each of a plurality of slidably displaceable supports 161 to be loaded onto the strip 151. Each of the plurality of slidably displaceable supports 161 has a pair of legs 163 which partially surround the length of the support 161.

The support 101 is seen with a magnetic strip layer 53. Support 101 has a width "X" of sufficient magnitude to accommodate not only the strip 151, but also the width of the legs 163 of the plurality of slidably displaceable supports 161, as they extend around the strip 151. The strip 151 and the plurality of slidably displaceable supports 161 are commercially available, and support 101 is specially designed to support strip 151. The strip 151 has a pair of apertures 165 and 167 which are at least one of chamfered or countersunk and deep enough that threaded members 169 extend sufficiently within said chamfer or countersink so that no blocking height will inhibit the movement of the plurality of slidably displaceable supports 161. Each of the threaded members 169 engage a nut 34, as before, which may preferably be a hexagonal nut 34 or any other shape capable of being captured by the pair of oppositely disposed flat surfaces 107 and 109 for support 101. The strip 151 can have each of the plurality of slidably displaceable supports 161 added and removed even when the strip 151 is supported by the support 101.

Further, the support 101, like the support 23, can be of any length and can support multiple strips 25, 151. A subsequent N strips is represented in phantom by the numeral 175. In this manner, a single support 23, 101 can be provided with multiple strips 25, 151 for even more efficient storage of tools.

Referring to FIG. 6, an end view of the support 101 is seen with a metal strip 25 having a somewhat rectangularly shaped support clip 181 shown inserted within a socket 61. Further, metal strips 25 and solid shaped strips 151 can be placed on the same support 23, 101. FIG. 6 illustrates the nut 34 engaging the threaded member 33 to secure a metal strip on to the support 101. The width of the side walls 107 and 109 are such as to engage the flat sides of the nut 34 to prevent nut 34 from turning. This eliminates the need for any other holding structure within the main entrance slot 103.

While the present invention has been described in terms of a device and system in which an elongate strip with tool support members are used to support tools and which is itself more properly supported in a utility base configured to facilitate movable and rest position stability, manual grasping and manipulation, written communication and identification, and in particular formation of the system as a retrofit with existing tool supports, especially elongate strip type tool supports, one skilled in the art will realize that the structure and techniques of the present invention can be applied to many appliances. The present invention may be applied in any situation where an existing ordered support is to have its utilization enhanced by connection to a more stable support base.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A support system comprising:

a support having an upper surface, a lower surface, a first and a second side surface, said first and said second side surfaces having a recess to facilitate manual grasping of said support and a first and a second end surface, said upper surface including an accommodation slot having a pair of side walls and a bottom; said bottom being interrupted by an entrance slot bound by a pair of oppositely facing projections leading to a main slot, which is wider than said entrance slot;

a magnetic member attached to said lower surface of said support;

a strip secured to said support utilizing said pair of oppositely facing projections wherein said strip includes an aperture and wherein said strip is secured to said support by engagement of a threaded member inserted through said aperture of said strip and said entrance slot, with a nut residing within said main slot; and tool support members for supporting tools and supported by and slidable along said strip to enable ordering of different size tools to enable a strip of tools to be independently manually carried to a work site.

2. The support as recited in claim 1 wherein said support is extruded and has a constant axial profile along its length.

3. A support system comprising:

an extruded support having a constant axial profile along its length and having an upper surface, a lower surface, a first and a second side surface and a first and a second end surface, said upper surface including an accommodation slot having a pair of side walls and a bottom; said bottom being interrupted by an entrance slot bound by a pair of oppositely facing projections leading to a main slot, which is wider than said entrance slot;

a strip secured to said support utilizing said pair of oppositely facing projections; and tool support members for supporting tools and supported by and slidable along said strip to enable ordering of different size tools, and wherein said support includes at least one side slot between said bottom of said accommodation slot and one of said pair of side walls of said accommodation slot.

4. The support as recited in claim 3 wherein said strip includes an aperture and wherein said strip is secured to said support by engagement of a threaded member inserted through said aperture of said strip and said entrance slot, with a nut residing within said main slot.

5. The support as recited in claim 3 wherein said strip includes a first rounded end and a second flat end and an extension adjacent said first rounded end for enabling said strip to accept a tool support member loaded from said first rounded end while said strip is supported by said support.

6. The support as recited in claim 3 and further comprising a magnetic member attached to said lower surface of said support.

7. The support as recited in claim 3 wherein said first and said second side surfaces are recessed to facilitate manual grasping of said support.

8. The support as recited in claim 7 wherein each of said first and said second side surfaces are bound by a pair of oppositely disposed slots integral with said support to facilitate support of a planar insert having an expanse generally parallel to said side surfaces and having a pair of opposite edges for interfitting within said oppositely disposed slots.

9. The support as recited in claim 8 and further comprising a message insert supported by said pair of oppositely disposed slots of one of said first and said second side surfaces and covering a portion of said one of said first and said second side surfaces.

10. The support as recited in claim 3 and further comprising at least a second strip secured to said support.

11. The support as recited in claim 3 wherein said support has a constant axial profile along its length.

12. The support as recited in claim 3 and further comprising an end cap attached to one of said first and said second end surfaces.

13. The support as recited in claim 3 and further comprising a hanger attached to one of said first and said second end surfaces.

14. A support system comprising:

a support having an upper surface, a lower surface, a first and a second side surface and a first and a second end surface, said upper surface including an accommodation slot having a pair of side walls and a bottom; said bottom being interrupted by an entrance slot bound by a pair of oppositely facing projections leading to a main slot, which is wider than said entrance slot;

a strip, including an aperture and secured to said support by engagement of a threaded member having threads that engage said pair of oppositely facing projections of said entrance slot; and tool support members for supporting tools and supported by and slidable along said strip to enable ordering of different size tools.

15. The support as recited in claim 14 wherein said strip includes an uppermost surface and wherein said aperture is at least one of chamfered or countersunk to enable said threaded member to reside below said uppermost surface such that said tool support members can remain slidably supported along said strip without obstruction by said threaded member.

16. The support as recited in claim 14 and further comprising an extended area magnetic member attached to said lower surface of said support.

17. The support as recited in claim 14 wherein said first and said second side surfaces are recessed to facilitate manual grasping of said support.

18. The support as recited in claim 17 wherein each of said first and said second side surfaces are bound by a pair of oppositely disposed slots integral with said support to facilitate support of a planar insert having an expanse generally parallel to said side surfaces and having a pair of opposite edges for interfitting within said oppositely disposed slots.

* * * * *